US008353806B2

(12) United States Patent
Kim

(10) Patent No.: US 8,353,806 B2
(45) Date of Patent: Jan. 15, 2013

(54) INDEPENDENT ELECTRIC POWER TYPE SPEED RACE APPARATUS

(75) Inventor: Yo-Seob Kim, Gimpo-si (KR)

(73) Assignee: Design Park Development Co., Ltd., Seoul (KR)

( * ) Notice: Subject to any disclaimer, the term of this patent is extended or adjusted under 35 U.S.C. 154(b) by 206 days.

(21) Appl. No.: 12/989,710

(22) PCT Filed: Oct. 20, 2009

(86) PCT No.: PCT/KR2009/006056
§ 371 (c)(1),
(2), (4) Date: Oct. 26, 2010

(87) PCT Pub. No.: WO2011/007934
PCT Pub. Date: Jan. 20, 2011

(65) Prior Publication Data

US 2011/0177915 A1 Jul. 21, 2011

(30) Foreign Application Priority Data

Jul. 16, 2009 (KR) ..... 10-2009-0064714

(51) Int. Cl.
*A63B 71/00* (2006.01)

(52) U.S. Cl. ..... 482/4; 482/8; 482/57; 482/901

(58) Field of Classification Search ..... 482/1–9, 482/51, 57, 900–902; 463/6, 7; 434/247
See application file for complete search history.

(56) References Cited

U.S. PATENT DOCUMENTS

| | | | | |
|---|---|---|---|---|
| 4,542,897 | A * | 9/1985 | Melton et al. | 463/7 |
| 5,213,555 | A * | 5/1993 | Hood et al. | 482/57 |
| 8,187,154 | B2 * | 5/2012 | Shum et al. | 482/8 |
| 2008/0125203 | A1 * | 5/2008 | Sato et al. | 463/6 |

* cited by examiner

*Primary Examiner* — Glenn Richman
(74) *Attorney, Agent, or Firm* — Sherr & Jiang, PLLC

(57) ABSTRACT

An independent electric power type speed race apparatus is disclosed. The independent electric power type speed race apparatus comprises a first health cycle comprising a first pedal, a first cycle rotary body rotating by handling of the first pedal, and a first cycle load driving part working as a load checking the rotation of the first cycle rotary body; a first cycle speed sensor sensing a rotation speed of the first cycle rotary body; a second health cycle comprising a second pedal, a second cycle rotary body rotating by handling of the second pedal, and a second cycle load driving part working as a load checking the rotation of the second cycle rotary body; a second cycle speed sensor sensing a rotation speed of the second cycle rotary body; a display plate installed at the front of the first health cycle and the second health cycle.

9 Claims, 5 Drawing Sheets

INDEPENDENT ELECTRIC POWER TYPE SPEED RACE APPARATUS

CROSS REFERENCE TO PRIOR APPLICATIONS

This application is a National Stage Patent Application of International Patent Application No. PCT/KR2009/006056 (filed on Oct. 20, 2009) under 35 U.S.C. §371, which claims priority to Korean Patent Application No. 10-2009-0064714 (filed on Jul. 16, 2009), which are all hereby incorporated by reference in their entirety.

TECHNICAL FIELD

The present invention relates to an independent electric power type speed race apparatus, and more particularly to an independent electric power type speed race apparatus which is installed in an indoor area or an outdoor area, and can maximizes an exercise effect by exercising for a promoting health together with enjoying a race game.

BACKGROUND ART

As a concern about health is increasing recently, a concern about an indoor and outdoor exercise is increasing too.

Depending on these social trends, jogging track and exercise equipment are installed and in an apartment complex which is constructed by the construction firm as well as in the park which is constructed by national or local government.

Also, we can easily find health club around us. A treadmill and a health cycle are a typical example of the exercise equipments installed in a health club.

Of these, a health cycle is exercise equipment of which an exerciser takes exercise indoor by rotating a pedal as like riding a real cycle. And it is possible to increase the intensity of the exercise by controlling volume of a load applied to the pedals.

However, because an exerciser takes exercise alone and repeats a simple motion in case of an ordinary health cycle, he is prone to get tired of that exercise. So, it is difficult to continue an exercise enough to have a desired effect of an exercise.

Therefore, health clubs install a television monitor at the front of a health cycle to prevent such boring.

DISCLOSURE

Technical Problem

Therefore, the present invention has been made in view of the above problems, and it is an object of the present invention to provide an independent electric power type speed race apparatus which is installed in an indoor area or an outdoor area, and can maximizes a exercise effect by exercising for a promoting health together with enjoying a race game.

Technical Solution

In accordance with an aspect of the present invention, the above and other objects can be accomplished by the provision of an independent electric power type speed race apparatus comprising: a first health cycle comprising a first pedal, a first cycle rotary body rotating by handling of the first pedal, and a first cycle load driving part working as a load checking the rotation of the first cycle rotary body; a first cycle speed sensor sensing a rotation speed of the first cycle rotary body; a second health cycle comprising a second pedal, a second cycle rotary body rotating by handling of the second pedal, and a second cycle load driving part working as a load checking the rotation of the second cycle rotary body; a second cycle speed sensor sensing a rotation speed of the second cycle rotary body; a display plate installed at the front of the first health cycle and the second health cycle; a plurality of first LEDs installed on the front side of the display plate and forming a first race track; a plurality of second LEDs installed on the front side of the display plate and forming a second race track in the face of the first race track; and a main processor controlling the race between the first race cycle and the second race cycle by turning on the plurality of first LEDs forming the first race track in sequence according to the rotation speed of the first cycle rotary body which is sensed by the first cycle speed sensor and turning on the plurality of second LEDs forming the second race track in sequence according to the rotation speed of the second cycle rotary body which is sensed by the second cycle speed sensor.

Herein, the first health cycle further comprises a first operating button outputting a first operating signal; the second health cycle further comprises a second operating button outputting a second operating signal; and the main processor controls the first cycle load driving part and the second cycle load driving part to change the load transmitted to the first cycle rotary body and the second cycle rotary body according to whether the first operating signal and the second operating signal from the first operating button and the second operating button are received when an incident section provided in the first race track and the second race track respectively is come during the turning-on of the plurality of first LEDs and the plurality of second LEDs.

Also, the first race track and the second race track are formed on the front side of the display plate in the shape of '8' and face each other.

Herein, the independent electric power type speed race apparatus further comprises a first segment display part and a second segment display part installed on the front side of the display plate; wherein the main processor display information about the rotation speed of the first cycle rotary body which is sensed by the first cycle speed sensor and information about the rotation speed of the second cycle rotary body which is sensed by the second cycle speed sensor through the first segment display part and the second segment display part, respectively.

Also, the independent electric power type speed race apparatus further comprises a sound output part outputting a sound according to control of the main processor; wherein the main processor outputs a warning sound through the sound output part to the first health cycle or the second health cycle when the first operating signal or the second operating signal is not received in the state that the incident section is come; and wherein the main processor outputs a passing sound through the sound output part to the first health cycle or the second health cycle when the first operating signal or the second operating signal is received in the state that the incident section is come.

ADVANTAGEOUS EFFECTS

As described above, the present invention provides an independent electric power type speed race apparatus which is installed in an indoor area or an outdoor area, can break up the boredom caused by a conventional health cycle, and can maximize a exercise effect by exercising for a promoting health together with enjoying a race game which is played by two users.

Also, an incident is come while the user enjoys the race game and the load is changed according to whether the user responses to the incident. Thus the user can concentrate on the race game all the more, and then exercise effect is maximized.

Also, the user can experience the race game on the real road, such as a slope road through loads against the health cycle which are supplied by sections and are different from each other.

DESCRIPTION OF DRAWINGS

The above and other objects, features, and other advantages of the present invention will be more clearly understood from the following detailed description taken in conjunction with the accompanying drawings, in which.

MODE FOR INVENTION OR DETAILED DESCRIPTION

Now, preferred embodiments of the present invention will be described in detail with reference to the annexed drawings.

Figure 1:
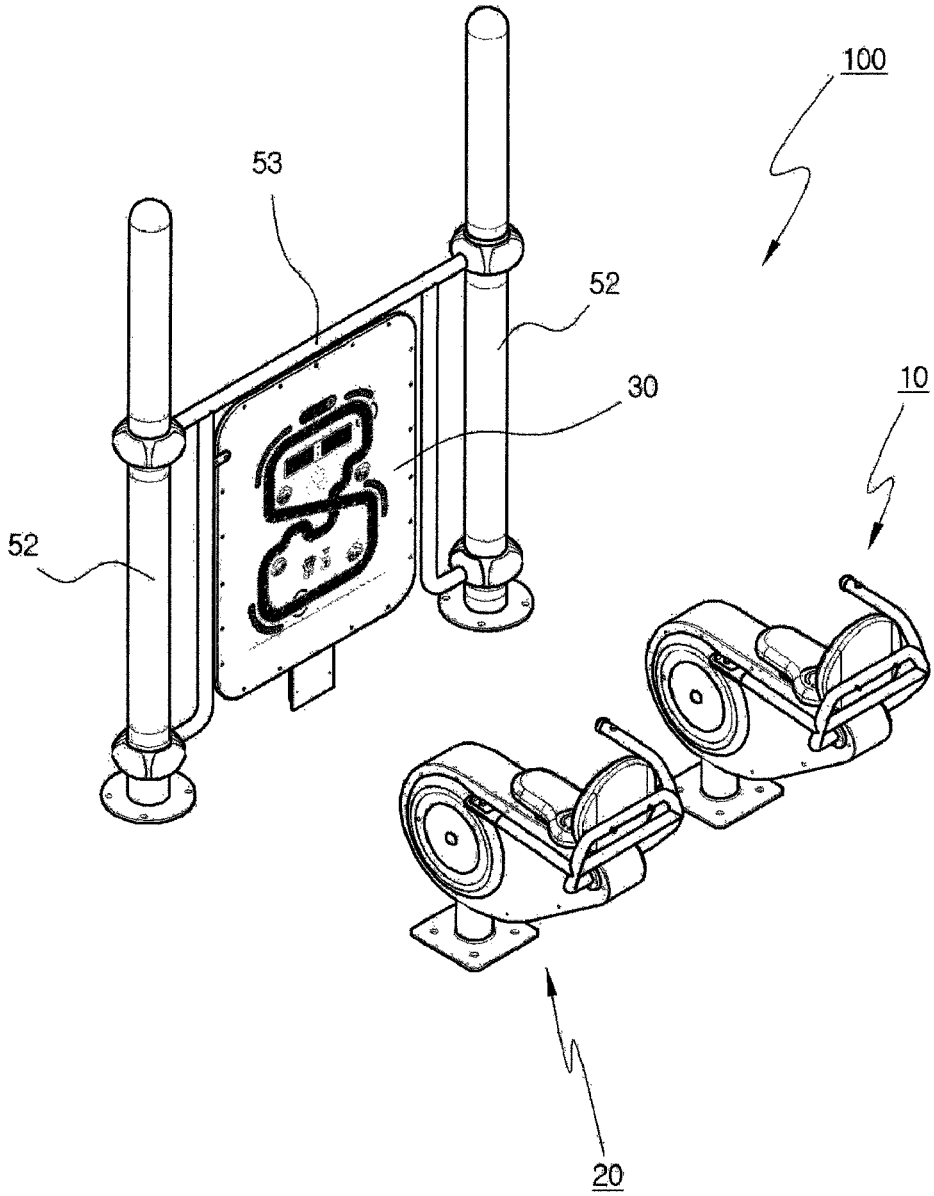
FIG. 1 is a perspective view illustrating an independent electric power type speed race apparatus according to the present invention.

FIG. 1 is perspective view illustrating an independent electric power type speed race apparatus. As shown in FIG. 1, the independent electric power type speed race apparatus 100 according to the present invention comprises a supporting frame 51 and 52, a first health cycle 10, a second health cycle 20, and a display plate 30.

The display plate 30, as shown in FIG. 1, is supported by the support frame 51 and 52, and is placed at the position and the height where an user can look at the display plate 30 when the user sits on the first health cycle 10 and the second health cycle 20. Herein, the detail description about the display plate 30 is mentioned later.

The support frame 51 and 52 is installed in perpendicularity and pairs on a place where the independent electric power type speed race apparatus 100 according to the present invention is installed, and then supports the display plate 30. Herein, a sub frame may be connected to and between the pair of the support frames 51 and 52, as shown in FIG. 1. Thus, the display plate 30 can be more stable by being supported by the pair of the support frames 51 and 52 and the sub frame 53.

The first health cycle 10 and the second health cycle 20 are positioned at the predetermined distance from the display plate 30, where the user can look at the display plate positioned at the front thereof 30 when the user sits on the first health cycle 10 and the second health cycle 20.

Figure 2:
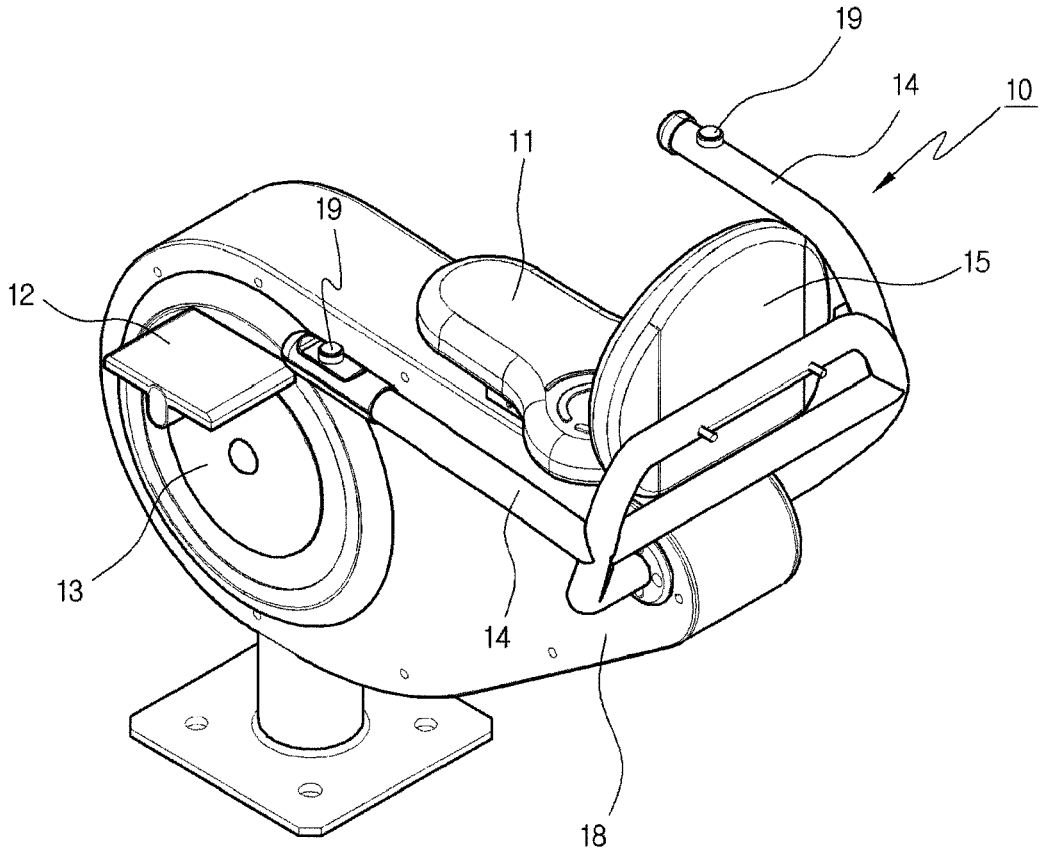
FIGS. 2 and 3 are views illustrating a constitution of a first health cycle of the independent electric power type speed race apparatus according to the present invention.
Figure 3:
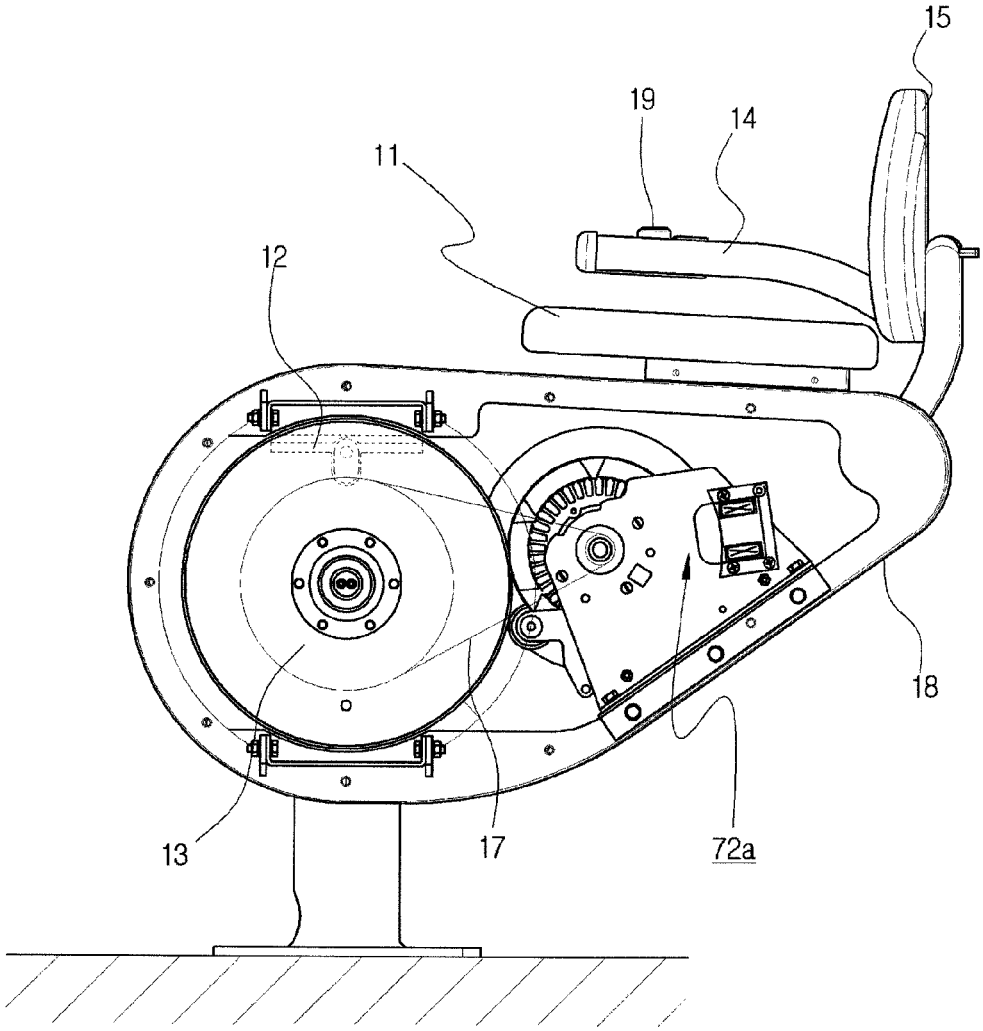

The first health cycle 10, as shown in FIGS. 2 and 3, may comprise a first pedal 12, a first cycle rotary body 13, a first cycle load driving part 72*a*, and a first operating button 75*a*.

The first pedal 12 on which the user's feet are put in the state that the user sits on a saddle 11 of the first health cycle 10 is used for rotating the first cycle rotary body 13. Herein, the first pedal 12 is installed on both side of the first health cycle 10 in correspondence with the user's feet.

The first cycle rotary body 13 rotates according to handling of the first pedal 12. Herein, the first cycle rotary body 13 is rotatablely contained in and supported by a cycle main body 18. Also, the first cycle rotary body 13 is connected to the first cycle load driving part 72*a*, as shown in FIG. 3.

Also, the first cycle load driving part 72*a* works as a load checking the rotation of the first cycle rotary body 13 according to a main processor 70 which is described later. In the present invention, the first cycle rotary body 13 and the first cycle load driving part 72*a* is connected to each other through a belt 17, thus the first cycle load driving part 72*a* can work as the load checking the rotation of the first cycle rotary body 13 while the first cycle load driving part 72*a* rotates according to the rotation of the first cycle rotary body 13. That is, as shown in FIG. 3, an electromagnet is provided in the first cycle load driving part 72*a*, and the load can be changed by a change of a magnetic force of the electromagnet according a change of a current supplied to the electromagnet.

Meanwhile, the first operating part 75*a* is provided in a predetermined position of the first health cycle 10, and outputs a first operating signal when the user push down the first operating button 75*a*. Herein, the first operating signal is transmitted to the main processor 70 which is described later.

The first operating button 75*a* according to the present invention is place on a position where the user is push down the first operating button 75*a* easily in the state that the user sits on the saddle 11 and operates the first pedal 12, that is in the state that the user uses the first health cycle 10. In FIGS. 2 and 3, the first operating button 75*a* is provided on a pair of handles 14 which is gripped by the user while the user uses the first health cycle 10, respectively.

A reference number 15 in FIGS. 2 and 3 which is not mentioned above indicates a backrest supporting the user's back.

Also, the second health cycle 20 may comprise a second pedal, a second cycle rotary body, a second cycle load driving part 72*b*, a second operating button 75*b*, a belt, a handle, and a backrest in correspondence with the first health cycle 10, and structures and functions thereof are correspondence with the elements of the first health cycle 10, respectively. Thus, a detail description about the elements of the second health cycle 20 is omitted.

Figure 4:
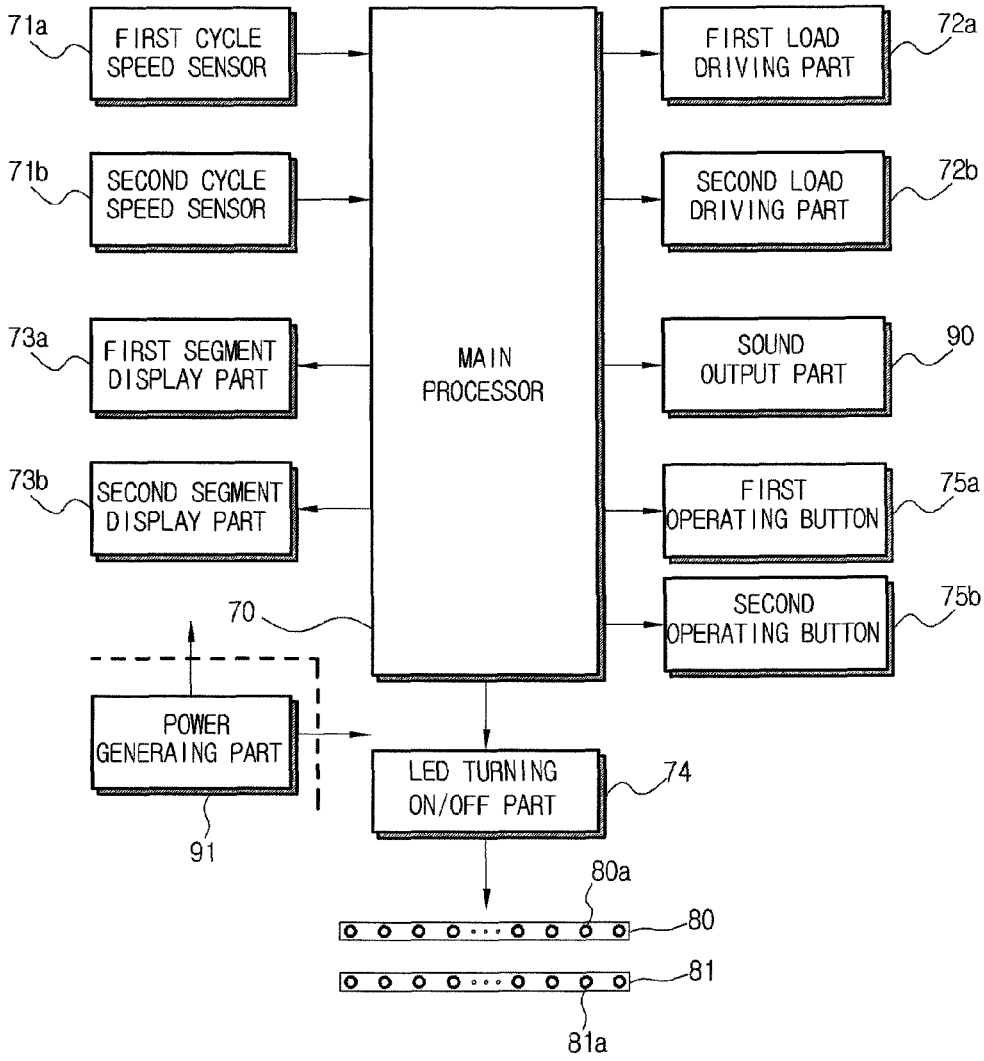
FIG. 4 is a control block diagram describing the independent electric power type speed race apparatus according to the present invention.

Meanwhile, as shown in FIG. 4, the independent electric power type speed race apparatus 100 according to the present invention further comprises a first cycle speed sensor 71*a*, a second cycle speed sensor 71*b*, a plurality of first LEDs (light emitting diodes), a plurality of second LEDs, and the main processor 70.

The first cycle speed sensor 71*a* senses a rotation speed of the first cycle rotary body 13 of the first health cycle 10. Also, the second cycle speed sensor 71*b* senses a rotation speed of the second cycle rotary body of the second health cycle 20. Herein, the first cycle speed sensor 71*a* and the second cycle speed sensor 71*b* are installed in a predetermined area of the first health cycle 10 and the second health cycle 20, respectively, and provided capable of sensing the rotation speed of the first cycle rotary body 13 and the second cycle rotary body while the first cycle rotary body 13 and the second cycle rotary body rotate according to operation of the first pedal 12 and the second pedal by the user. For example, the first speed sensor 71*a* and the second speed sensor 71*b* may be provided with a type of an infrared sensor which is capable of sensing the rotation of the first cycle rotary body 12 and the second cycle rotary body.

Figure 5:
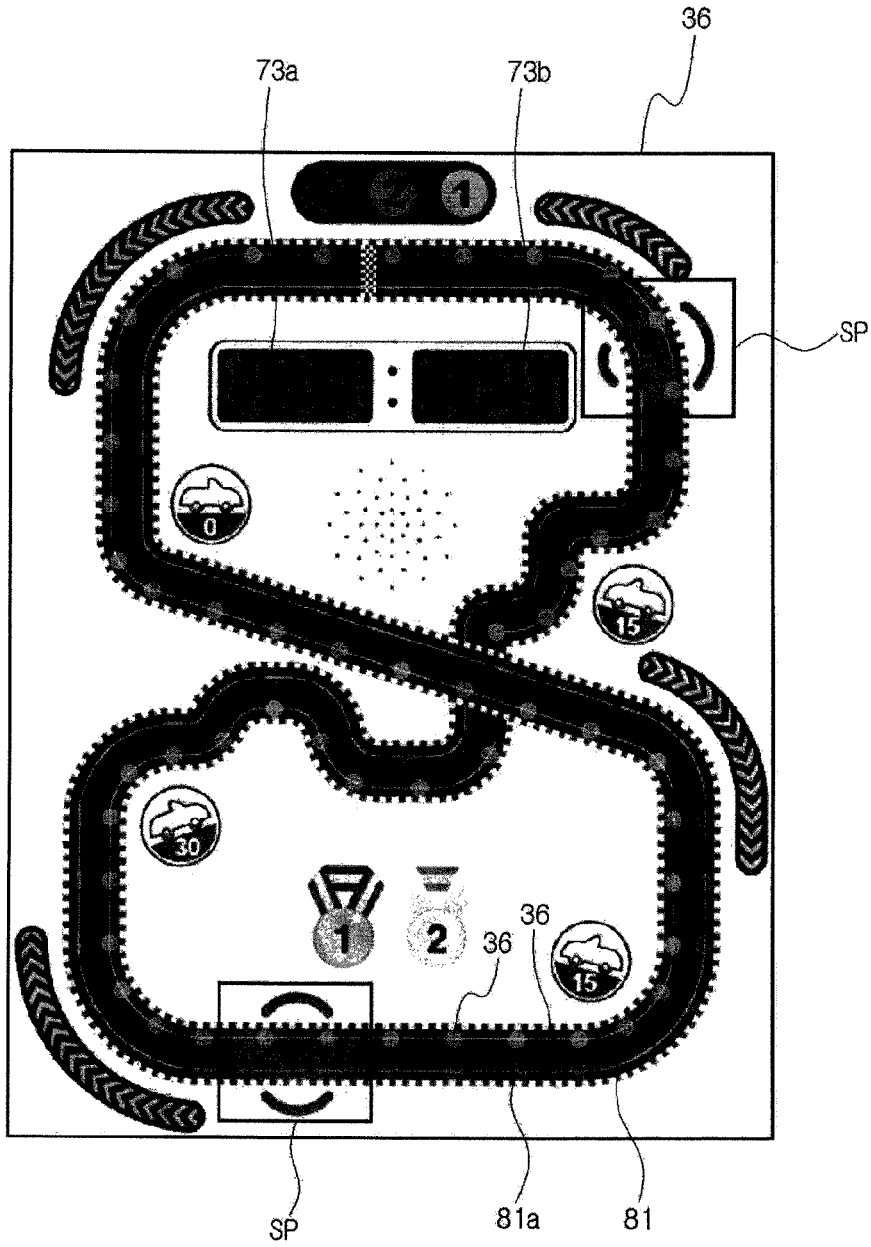
FIG. 5 is a view illustrating an example of a display plate of the independent electric power type speed race apparatus according to the present invention.

The plurality of first LEDs 80*a* is installed on a front side of the display plate 30. FIG. 5 shows an example of the display plate 30 according to the present invention. In FIG. 5, the plurality of first LEDs 80*a* is arranged on the front side of the display plate in the shape of '8'. Herein, the plurality of first LEDs 80*a* arranged in the shape of '8' forms a first race track 80 about the first health cycle 10.

Also, as shown in FIG. 5, the plurality of second LEDs 81*a* is installed on the front side of the display plate 30 and forms a second race track 81 about the second health cycle 20. Herein, the plurality of second LEDs 81*a* is arranged in the shape of '8' and faces the plurality of first LEDs 80*a*, so that the second race track 81 is formed apart from the first race track 80 at the predetermined distance.

The main processor 70 controls a LED turning on/off part 74 to selectively turn on and off the plurality of first LEDs 80*a* and the plurality of second LEDs 81*a* forming the first race track 80 and the second race track 81. Herein, the main processor 70 controls the LED turning on/off part 74 to turn on the plurality of first LEDs 80*a* forming the first race track 80 in sequence according to the rotation speed of the first cycle rotary body 13 which is sensed by the first cycle speed sensor 71*a*.

Also, the main processor 70 controls the LED turning on/off part 74 to turn on the plurality of second LEDs 81*a* forming the second race track 81 in sequence according to the rotation speed of the second cycle rotary body 14 which is sensed by the second cycle speed sensor 71*b*.

According to the above mentioned constitution, two users sit the first health cycle 10 and the second health cycle 20 and operate the first pedal 12 of the first health cycle 10 and the second pedal of the second health cycle 20 for race game, respectively. And then, the first cycle speed sensor 71*a* and the second cycle speed sensor 71*b* sense the rotation speed of the first cycle rotary body 13 and the second cycle rotary body and transmit the main processor 70.

And then, the main processor 70 turns on the first LEDs 80*a* in sequence as many as moving distance of the first health cycle 10 according to the rotation speed from the first cycle speed sensor 71*a*, and turns on the second LEDs 81*a* in sequence as many as moving distance of the second health cycle 20 according to the rotation speed from the second cycle speed sensor 71*b*. Thus, the main processor 70 controls the race game between the first health cycle 10 and the second health cycle 20.

Herein, the user can check the progress of the race game by checking how many the first LEDs 80*a* forming the first race track 80 and the second LEDs 81*a* forming the second race track 81 are turned on. Thus, the user can not only enjoy the race with the partner but also exercise through the health cycle 10 and 20.

Meanwhile, the independent electric power type speed race apparatus 100 may be provided with an incident section SP in the first race track 80 and the second race track 81, as shown in FIG. 5. Herein, when the incident section in the first race track 80 and the second race track 81 is come while the plurality of first LEDs 80*a* and the plurality of second LEDs 81*a* are turned on in sequence, the main processor 70 check whether the first operating signal and the second operating signal from the first operating button 75*a* and the second operating button 75*b* are received.

And then, the main processor 70 controls the first cycle load driving part 72*a* to maintain the load transmitted to the first cycle rotary body 13 from the first cycle load driving part 72*a* in the case that the first operating signal is received in the incident section SP of the first race track 80, and controls the first cycle load driving part 72*a* to increase the load transmitted to the first cycle rotary body 13 from the first cycle load driving part 72*a* in the case that the first operating signal is not received in the incident section SP of the first race track 80.

In the same manner, the main processor 70 controls the second cycle load driving part 72*b* to maintain the load transmitted to the second cycle rotary body from the second cycle load driving part 72*b* in the case that the second operating signal is received in the incident section SP of the second race track 81, and controls the second cycle load driving part 72*b* to increase the load transmitted to the second cycle rotary body from the second cycle load driving part 72*b* in the case that the second operating signal is not received in the incident section SP of the second race track 81.

That is, the main processor 70 controls the first cycle load driving part 72*a* and the second cycle load driving part 72*b* to change the load transmitted to the first cycle rotary body 13 and the second cycle rotary body according to whether the first operating signal and the second operating signal are received in the incident section of the first race track 80 and the second race track 81.

Accordingly, an incident is come while the user enjoys the race game, the load is changed according to whether the user responses to the incident, and then the user can concentrate on the race game all the more. Thus, exercise effect is maximized by means that the user can concentrate on using the first health cycle 10 and the second health cycle 20.

Meanwhile, the main processor 70 may separate the first race track 80 and the second race track 81 into a plurality of sections, respectively, and control the first cycle load driving part 72*a* and the second cycle load driving part 72*b* to change the load transmitted to the first cycle rotary body 13 and the second cycle rotary body by the section.

For example, as shown in FIG. 5, the main processor 70 may regard curved sections of the first race track 80 and the second race track 81 as a slope road, and control the first cycle load driving part 72*a* and the second cycle load driving part 72*b* to transmit the load corresponding to the 15° or 30° slope road to the first cycle rotary body 13 and the second cycle rotary body.

Also, the main processor 70 may regard straight sections of the first race track 80 and the second race track 81 as a 0° slope road, that is a flat road, and control the first cycle load driving part 72*a* and the second cycle load driving part 72*b* to transmit the load corresponding to the flat road to the first cycle rotary body 13 and the second cycle rotary body.

Accordingly, the user can experience the race game on the real road having the slope through loads which are supplied by sections and are different from each other.

Meanwhile, the independent electric power type speed race apparatus 100 may comprise a first segment display part 73*a* and a second segment display part 73*b* installed on the front side of the display plate 70, as shown in FIGS. 4 and 5.

Herein, the main processor 70 may display information about the rotation speed of the first cycle rotary body 13 which is sensed by the first cycle speed sensor 71*a* through the first segment display part 73*a*, and information about the rotation speed of the second cycle rotary body which is sensed by the second cycle speed sensor 71*b* through the second segment display part 73*b*.

Also, information about the rotation speed displayed on the first segment display part 73*a* and the second segment display part 73*b* may comprise the rotation speed of the first cycle rotary body 13 and the second cycle rotary body or the moving distance calculated on the basis of the rotation speed.

Also, information about the rotation speed display on the first segment display part 73*a* and the second segment display part 73*b* may comprise information about a remained distance to an end of the race game. For example, if the race game according to the present invention is continued till 10 rounds of the first race track 80 and the second race track 81 in FIG. 5, the number of remained tracks may be displayed on the first segment display part 73*a* and the second segment display part 73*b*.

A reference number 90 in FIG. 4 which is not mentioned above indicates a sound output part 90. The main processor 70 may output music, information about the track, various sounds or comments, etc. through the sound output part 90 during the race game. Herein, the main processor 70 may output a warning sound such as a beep through the sound output part 90 to the first health cycle 10 or the second health cycle 20 when the first operating signal or the second operating signal is not received in the state that the incident section of the first race track 80 and the second race track 81 is come.

Also, the main processor 70 may output a passing sound through the sound output part 90 to the first health cycle 10 or the second health cycle 20 when the first operating signal or the second operating signal is received in the state that the incident section of the first race track 80 and the second race track 81 is come.

Also, when the race game starts according to operating the pedal of the first health cycle 10 or the second health cycle 20 by the user, the main processor 70 may inform the user of the start of the race game by outputting a starting sound of a car through the sound output part 90. In company with that, the main processor 70 may show the user the countdown of the start of the race game through turning on the first LEDs 80*a* and the second LEDs 80*b* in sequence such as a red light→a yellow light→a green light.

Meanwhile, the independent electric power type speed race apparatus 100 may comprise a power generating part 91, as shown in FIG. 4. The power generating part 91 converts a rotating motion of the first cycle rotary body 13 and the second cycle rotary body to electric energy, when the user rotates the first cycle rotary body 13 and the second cycle rotary body.

For example, the rotation of the first cycle rotary body 13 and the second cycle rotary body rotates an alternator of the power generating part 91 and then the power generating part 91 generates an alternating current. The alternating current is converted to a direct current through a rectifying circuit. Thus, the electric power can be supplied to circuit elements, such as the main processor 70, the LED turning on/off part 74, the first LEDs 80*a*, the second LEDs 81*a*, the first segment display part 73*a*, the second segment display part 73*b*, etc. of the independent electric power type speed race apparatus 100. Herein, the power generating part 91 may comprise an electric condenser (not shown) for storing the generated electric power.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A speed race apparatus using stationary bikes, comprising:

a first stationary bike for a first racer, including a first pedal, a first resistance adjuster being capable of changing a first resistance against a first pedaling by the first racer, and a first button for outputting a first signal;

a second stationary bike for a second racer, including a second pedal, a second resistance adjuster being capable of changing a second resistance against a second pedaling by the second racer, and a second button for outputting a second signal;

a display including a plurality of first LEDs forming a first race track for the first racer, and a plurality of second LEDs forming a second race track for the second racer; and a controller controlling the plurality of first LEDs to show the change of the first racer's location in the first race track according to speed and duration of the first pedaling, and controlling the plurality of second LEDs to show the change of the second racer's location in the second race track according to speed and duration of the second pedaling, wherein the first race track includes a first incident section in which the first resistance against the first pedaling is changed, the controller maintains the first resistance in case the first signal generated by the first button is received in the first incident section but increases the first resistance in case the first signal is not received in the first incident section, wherein the second race track includes a second incident section in which the second resistance against the second pedaling is changed the controller maintains the second resistance in case the second signal generated by the second button is received in the second incident section but increases the second resistance in case the second signal is not received in the second incident section.

2. The speed race apparatus according to claim 1, wherein the controller separates the first race track and the second race track into a plurality of sections, respectively, and controls the first resistance and the second resistance to be changed in each different section.

3. The speed race apparatus according to claim 1, wherein the first race track and the second race track are arranged in the shape of '8' and face each other.

4. The speed race apparatus according to claim 1, wherein the display includes a first area which displays s a first pedaling speed and a second area which displays a second pedaling speed.

5. The speed race apparatus according to claim 1, further comprising a sound output part outputting a sound according to a control of the controller;

wherein the sound output part outputs a first warning sound to the first stationary bike when the first signal is not received in the first incident section but outputs a first passing sound to the first stationary bike when the first signal is received in the first incident section; and wherein sound output parts outputs a second warning sound to the second stationary bike when the second signal is not received in the second incident section but outputs a second passing sound to the second stationary bike when the second signal is received the second incident section.

6. The speed race apparatus according to claim 1, wherein each of the first race track and the second race track includes a straight section and a curved section, wherein the controller regards the straight section as a flat road with a 0° slope and controls the first resistance and the second resistance to correspond to the flat road.

7. The speed race apparatus according to claim 1, wherein each of the first race track and the second race track includes a straight section and a curved section, wherein the controller regards the curved section as a sloped road with a predetermined degree of slope and controls the first resistance and the second resistance to correspond to the sloped road.

8. The speed race apparatus according to claim 1, further comprising a sound output part outputting a sound according to a control of the controller.

9. The speed race apparatus according to claim 1, further comprising a power generating part that converts a rotating motion of the first pedal and the second pedal to an electric energy.

* * * * *